United States Patent [19]

Shepherd et al.

[11] Patent Number: 4,576,764

[45] Date of Patent: Mar. 18, 1986

[54] FILL SLAT ASSEMBLY FOR COOLING TOWERS

[75] Inventors: G. Maury Shepherd; Charles E. Shepherd, both of Houston, Tex.

[73] Assignee: C. E. Shepherd Company, Houston, Tex.

[21] Appl. No.: 687,973

[22] Filed: Dec. 31, 1984

[51] Int. Cl.[4] ..... B01F 3/04

[52] U.S. Cl. ..... 261/111; 261/112; 261/DIG. 11; 428/99; 428/131; 428/174; 428/194

[58] Field of Search ..... 428/99, 131, 174, 194; 261/111, 112, 113, DIG. 11, DIG. 72

[56] References Cited

U.S. PATENT DOCUMENTS 4,133,851 1/1979 Ovard ..... 261/111

4,181,691 1/1980 Cates et al. ..... 261/DIG. 11

4,439,378 3/1984 Ovard ..... 261/DIG. 11

*Primary Examiner*—Alexander S. Thomas

*Attorney, Agent, or Firm*—Schwartz, Jeffery, Schwaab, Mack, Blumenthal & Evans

[57] ABSTRACT

The fill slat for use in water cooling towers comprises a perforated body portion, a central longitudinal rib, and downwardly inclined side flanges. The rib is inverted v-shape in cross-section and functions as a rigidifying beam for the fill slat. The rib is open at its bottom, thereby permitting a plurality of fill slats to be nested to reduce shipping costs. The side flanges are formed with slots, certain of which are angled, to receive the supporting wires. A holding clip can be additionally provided to reduce rolling or longitudinal movement of the fill slat.

12 Claims, 8 Drawing Figures

FIG. 4.
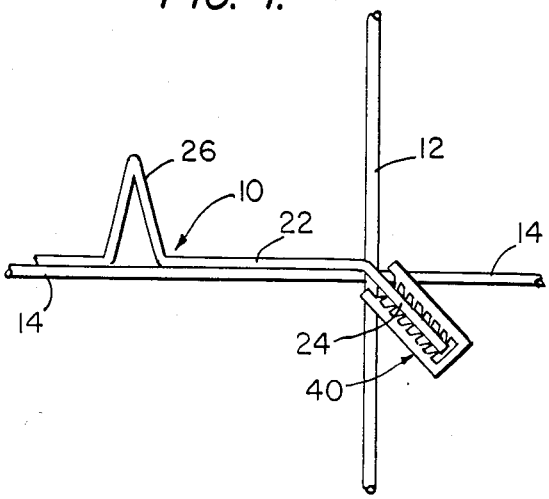
FIG. 5.
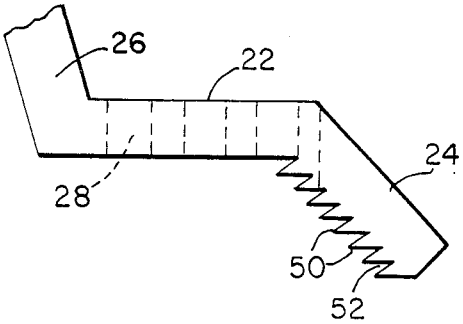
FIG. 6.
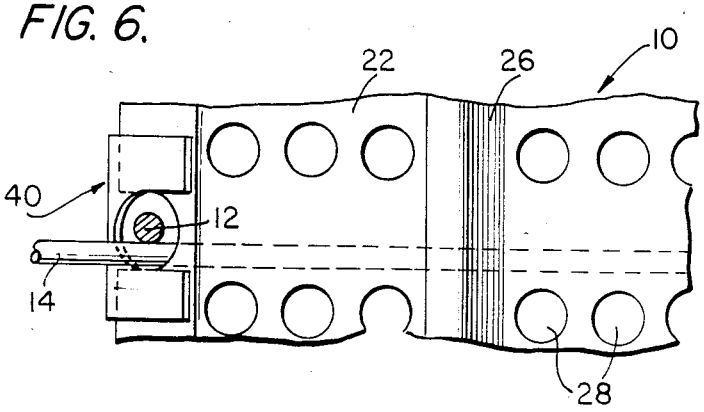
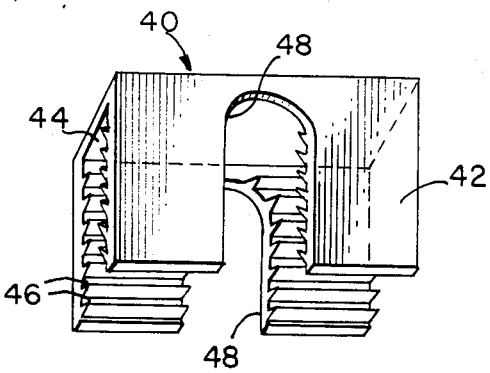
FIG. 7.
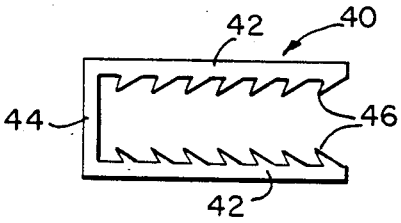
FIG. 8.

FILL SLAT ASSEMBLY FOR COOLING TOWERS

BACKGROUND OF THE INVENTION

The present invention relates as indicated to a fill slat assembly for cooling towers, and relates more particularly to a perforated fill slat assembly for use with cross-flow air systems.

The use of fill slats, also commonly referred to as splash bars, in cooling towers is well known in the art. The fill slats are normally positioned in the tower in vertically and laterally spaced position to provide a tortuous passage for the water descending in the cooling tower. In this manner, the water is diverted upon contact with a particular fill slat and directed laterally to contact a laterally adjacent fill slat at a lower level in the cooling tower. Where fill slats are formed with perforations, water passing directly through the perforations will descend for contact with the fill slat positions directly below. In this manner, the water to be cooled, which is admitted at the top of the cooling tower, is broken up into droplets as it descends through the tower, thereby inhancing vaporization and thus cooling the water. Where water temporarily remains on the surface of the fill slat, it is in the nature of a very thin film, which likewise enhances vaporization. The cooling process is further enhanced by the flowing of air laterally through a side or sides of the tower in a direction generally either parallel or transverse to the fill slats, and then upwardly through the tower for exhausting the air from the top of the tower. The cooled water is collected at the bottom of the tower and routed for reuse for further cooling.

The prior art is replete with the fill slats or splash bars of the general type referred to above, and the use of fill slats having perforations is also well known in the art. Reference is made, for example, to U.S. Pat. Nos. 3,083,148 to Mojonnier; 3,389,895 to DeFlon; 3,647,191 to Fordyce; 3,743,257 to Fordyce; 4,020,130 to Ovard, and 4,133,851 to Ovard, all of which disclose performated fill members of varying configuration and function. Although the last mentioned Ovard patent is relevant to the present invention in certain respects, there are several disadvantages in connection with the handling and installation of the fill slat shown in Ovard. Although certain forms of fill slats shown in Ovard are provided with slotted bevelled edges, with the slots receiving the horizontal and vertical support wires or rods, rolling or tilting movement of the fill slats is not precluded, nor is longitudinal movement of the fill slat totally prevented. This latter feature is particularly important in view of the frictional contact between the wires and the slots and the consequent wear on the fill slats. Moreover, the construction of all of the several forms of Ovard are such that shipping costs are relatively high. The fill slats cannot be nested during shipment, and as a result the volume required for shipping a corresponding number of fill slats is substantially larger.

SUMMARY OF THE INVENTION

The present invention provides a number of distinct advantages over prior art fill slat assemblies of this type. The unique features and advantages of the invention are enummerated as follows:

1. The fill slat has a main body portion which is perforated, and lateral unperforated flanges at both sides thereof, with the total width of the fill slat being such, in relation to the spacing of the fill slats in the cooling tower, that the lateral edges overlap laterally disposed fill slats positioned beneath a particular fill slat, whereby all descending water must of necessity contact a series of fill slats during the descent of the water through the cooling tower. The slat is formed with a central rib of generally inverted v-shape, thereby providing a configuration permitting nesting of the fill slats during handling and shipment. This arrangement significantly decreases shipping and installation costs.

2. The inverted v-shaped center rib of the fill slat also functions to provide a more rigid slat construction, and consequently a capability to tolerate much higher water loading without deformation.

3. Notches are formed in longitudinally spaced relation along the inclined side flanges of the fill slat, with the depth of the notches being such that the support wires are accommodated entirely within the flanges. In this manner, superimposed and laterally adjacent edges of fill slats overlap to ensure water contact. Moreover, the notches formed adjacent to each end of the slat are preferably inclined with their axes directed toward the center of the slat, thereby serving to longitudinally lock the fill slat in position on the supporting wires.

4. Although the longitudinal locking feature just described is simple and effective in operation, a further feature of the invention comprises a hold-down clip which can be removably attached to the inclined edge of the fill slat at the location of the horizontal and vertical support wires. The clip is generally u-shaped in cross section, and is formed with slots in the legs thereof which accommodate the supporting wires when the clip is positioned on the flange. Both the flange surface and contiguous surface or surfaces of the clip are provided with complimentary serrated surfaces for retention of the clip when positioned on the flange. This not only prevents longitudinal movement of the fill slat relative to the supporting wires, but also precludes tilting or rolling over of the fill slat. This resultant stability is a distinct advantage in maintaining the fill slat in its properly oriented position despite the vibration and wind effect existing in the cooling tower.

5. In order to further minimize the wear on the fill slat, resilient reinforcing pads are preferably positioned below the body portion of the fill slat adjacent each slot in each side flange of each fill slat, with the resilient pads precluding deformation and wear of the body portion of the fill adjacent the slots.

6. The surface of the fill slat is preferably formed with a mat finish which improves the film forming characteristics of the fill, thereby enhancing the cooling efficiency of the fill slat.

These and other features of the invention will be more clearly understood as the following description proceeds in particular reference to the application drawings.

BRIEF DESCRIPTION OF THE DRAWINGS

In the application drawings:

FIG. 4 is a fragmentary end elevational view showing a portion of the fill slat, and the manner in which a holding clip is positioned over an edge of the fill slat for precluding movement of the fill slat relative to the supporting wires;

FIG. 5 is an enlarged view of a portion of the fill slat, showing the serrations of the lower surface of one flange of the fill slat;

FIG. 6 is a perspective view of the holding clip shown in operative position in FIG. 4;

FIG. 7 is a side elevational view of FIG. 6, showing in more detail the projections on the interior surfaces of the legs of the holding clip, and FIG. 8 is a fragmentary top plan view showing the holding clip mounted in position on the flange of the fill slat.

DETAILED DESCRIPTION OF THE PREFERRED EMBODIMENTS

Figure 1:
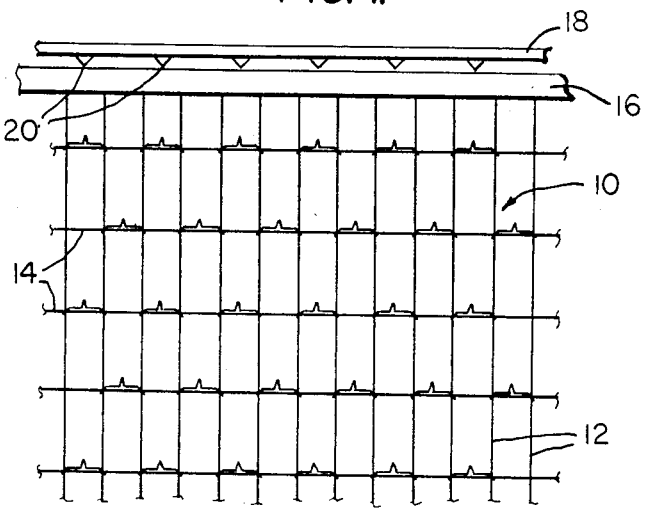
FIG. 1 is a generally schematic end view showing partially fragmentarily a section of the interior of the cooling tower, and specifically showing the fill slats constructed in accordance with the present invention, and the manner in which they are arranged on supporting wire hangers in the cooling tower.

Referring now in more detail to the application drawings, wherein like parts are indicated by like reference numberals, and initially to FIG. 1, there is illustrated therein an end view of a portion of a cooling tower in which the fill slat assemblies of the present invention are mounted. Each fill slat is commonly indicated at 10, with each fill slat being generally and diagrammatically shown in end view. The fill slats are supported on vertical supporting wires 12 and horizontal supporting wires 14, which are interconnected, for example, by welding, in grid fashion in a manner well known in the art. The wire grid system has accordingly been shown only diagrammatically in FIG. 1. The vertical support wires 12 are hung or suspended from a supporting frame member 16 mounted at the top of the cooling tower. Water to be cooled enters the cooling tower through a basin 18, which is formed with a series of spaced nozzles 20 through which the water is directed downwardly through the cooling tower.

The manner in which the fill slats 10 are mounted in spaced relation relative to each other is likewise conventional. The fill slats in each horizontal row are spaced, with the row immediately beneath being vertically disaligned from the superimposed row. In this manner, water is diverted laterally and descends to the row of fill slats positioned immediately below, with the water continuing such tortuous passage to enhance the formation of droplets and consequent evaporation. Water passing downwardly through the perforations in a particular fill slat descend for engagement with the fill slat positioned vertically below. For example, water passing through the perforations in a fill slat in the upper row will pass directly to the vertically aligned fill slat in the third row of slats, as shown in FIG. 1.

The fill slat assembly of the invention is primarily designed for use in crossflow cooling tower arrangements, with the method of or means for air flow forming no part of the present invention. In a crossflow arrangement, the air would normally pass longitudinally relative to the orientation of the fill slats and would be exhausted from the cooling tower through an exhaust opening (not shown) at the top of the cooling tower.

Figure 3:
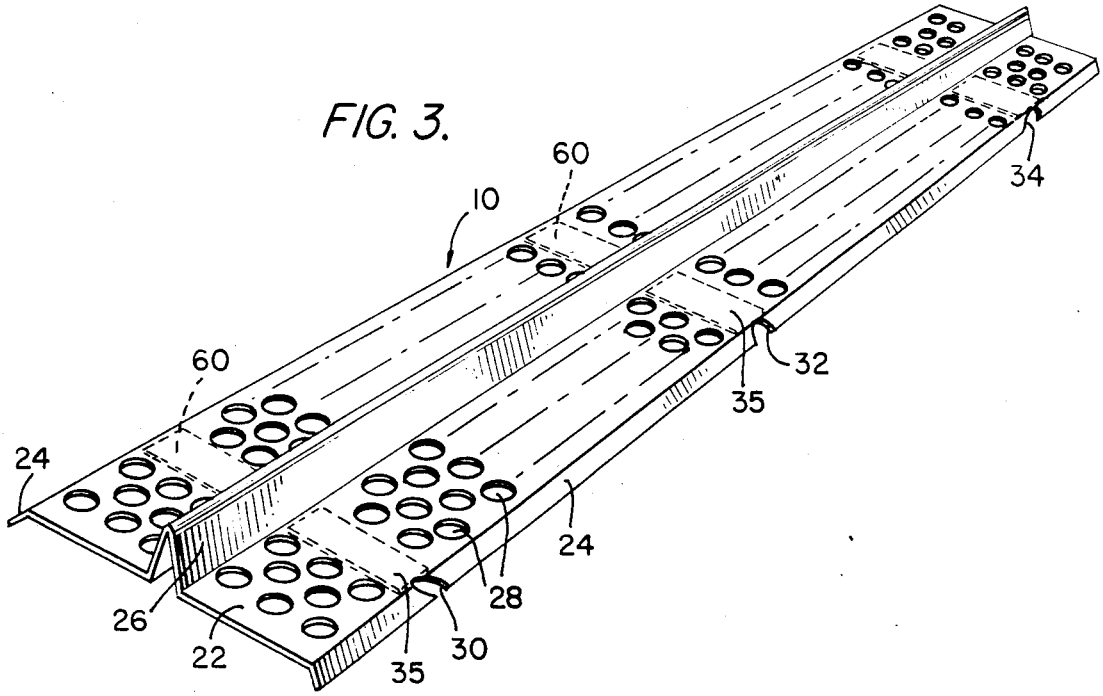
FIG. 3 is a perspective enlarged view of the fill slat.

Referring to FIG. 3, the construction of the fill slat 10 is shown in greater detail. The fill slat comprises a main body portion 22, side flanges 24, and a central rib 26 which is generally of inverted v-shape in cross section and extends upwardly from the plane of the body portion 22. The rib is unperforated and provides in effect a rigidifying beam for the fill slat whereby the slat is capable of substantially greater water loading without distorting or deforming.

A series of perforations or openings commonly designated at 28 are formed in the main body portion 22 of the fill slat. The center rib 26 and the flanges 24 are unperforated except for the slots 30, 32 and 34 formed at longitudinally spaced locations along the flange and to which more specific reference will be presently made. In the transverse region of the body portion adjacent the slots, there are unperforated areas 35 extending transversely across the body portion. The body is thus strengthened at the locations of the slots.

The fill slat 10 can be formed of polyvinylchloride, or any other sutable thermoplastic material, and is preferably formed by extrusion from a flat sheet. The method of manufacture, however, forms no part of the present invention. Other materials and methods can be utilized, e.g., formed sheet metal, fiber reinforced resin, or the like.

The fill slat is normally supplied in commonly used widths, for example, 4" and 6", and can be of any suitable length, for example 6'. In the 6" width form, for example, the following dimensions are preferred but not essential. The flanges 24 can be approximately 0.50" long and are downwardly directed at an angle of approximately 45° with the body portion 22 of the fill slat. The central rib is approximately 1.125" in height, with each side wall of the rib being angled approximately 15° relative to a vertical plane through the apex of the rib. The thickness of the fill slat can be varied to meet specifications, with 0.045" being entirely satisfactory. The width of the central rib at the bottom is approximately 0.750", and the spacing from the bottom of each side wall to the adjacent side flange is approximately 2.375". It has been discovered that a fill slat having the aforesaid dimensions provides highly satisfactory operating results in fill slat lengths typically encountered in cooling tower constructions.

Figure 2:
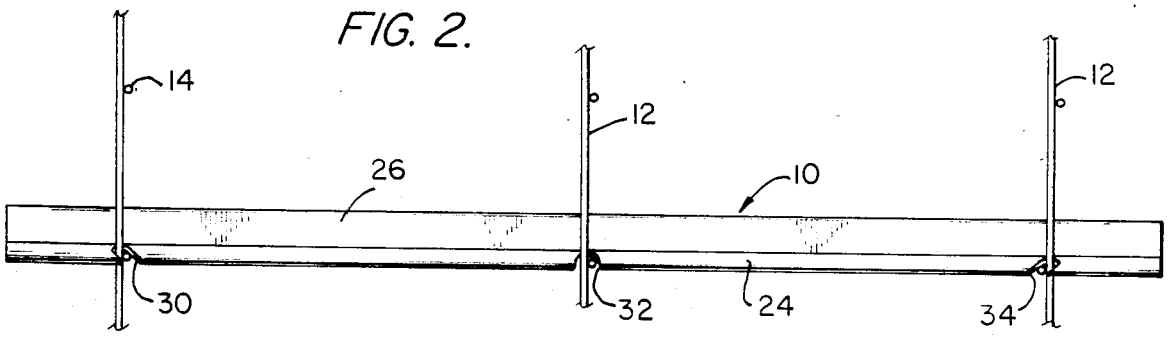
FIG. 2 is a side elevational view showing a single fill slat member supported on horizontal and vertical supporting wires, and showing the manner in which the downwardly inclined flanges of the fill slat are notched to receive the supporting wires.

FIG. 2 shows in more detail a single fill slat mounted in position on the vertical and horizontal supporting wires 12 and 14, respectively. The mounting of the wires in the slots 30 and 34 will be particularly noted. It will be seen in FIG. 3 that the slot 30 is angled toward a transverse vertical plane through the center of the fill slat. The fill slat 34 is similarly angled, with the axis thereof also being directed toward such transverse vertical plane. The central slot 32 is generally semicircular in shape and has an axis generally parallel to a transverse vertical axis of the fill slat.

When the fill slat is mounted as shown in FIG. 2, the vertical and horizontal wires 12 and 14 are positioned adjacent the closed end of the slot 30, and the vertical and horizontal wires by which the opposite end of the fill slot are supported are likewise positioned adjacent the closed end of the slot 34. Although FIG. 3 illustrates slot formations only on the flange 24 which is visable in that figure, it will be understood that similar slots are formed on the opposite flange 24, at corresponding locations. In this manner, longitudinal movement of the fill slat relative to the supporting wires is essentially precluded. This is particularly true if the wires are relatively force fitted into the respective slots 30 and 34.

As can be seen in FIGS. 1 and 4, the side flanges 24 extend beyond the vertical support wires 12 and below the horizontal support wires 14. The flanges 24 overlap the corresponding flanges 24 of fill slats positioned below and laterally of the fill slat whereby water descending in the cooling tower cannot bypass the fill slats during its descent. In order to more positively clamp the fill slats to the support wires, a holding clip generally indicated at 40 (FIG. 6) can be employed. The clip is generally u-shaped in cross section, comprising legs commonly designated 42 and a connecting web 44. The interior surfaces of the legs 42 are formed with longitudinal projections commonly shown at 46, with such projections being teeth-like and angled in a direction toward the web 44 of the clip, as most clearly seen in FIG. 7. Each leg 42 is formed with a central slot 48 the width and depth of which is such that the vertical and horizontal supporting wires are accommodated when the clip is positioned over the flange, as shown in FIGS. 4 and 8.

As shown in FIG. 5, at least the bottom surface of each flange 24, in at least the region around each slot 30, 32 and 34, is similarly formed with serrations or projections 50 which define therebetween recesses 52 for receiving projections 46 formed on the inner surfaces of the legs of the holding clip 40. In FIG. 5, only the bottom surface of the flange 24 is shown serrated, but it will be understood that the upper surface could be serrated as well. The recesses 52 compliment and are adapted to receive the projections 46 of the clip when the latter is inserted from the outer edge toward the top of the flange. This provides a locking effect for retaining the holding clip in place, with the clip positively precluding both longitudinal and rolling or tilting movements of the fill slat relative to the support wires. The clamping effect is such that vibration of the fill slat is also substantially precluded by greatly reducing relative movement between the fill slat and the supporting wires. Slot wear is thereby greatly reduced thereby prolonging the useful life of the fill slat.

Although the holding clip 40 can, if desired, be utilized at each slot 30, 32 and 34 on each flange of the fill slat, satisfactory results are normally obtained by utilizing the holding clip 40 only at the location of the central slot 32, on each side of the fill slat.

As above noted and described, the provision of the slots 30, 32 and 34 reduces longitudinal movement of the fill slats and the effects of vibration during operation. The movement of the fill slat is further inhibited by the use of holding clips 40. Despite a great reduction in fill slat movement, vibration within the cooling tower still tends to wear or cut the bearing surface of the slat. To inhibit or prevent such wear, resilient pads 60 are preferably positioned on the underside of the body portion 22 in the unperforated areas 35. As shown in dashed lines in FIG. 3, each pad extends from the bottom of the side wall of the rib to the juncture of the body portion and the flange 24. The pads confine deformation of the slots to the surrounding flange area, and prevent deformation of the adjacent body portion. This confining of slot wear substantially increases the useful life of the fill slats.

The resilient pads can be made of any suitable material, for example, a flexible vinyl, and can be bonded or otherwise secured to the underside of the body 22. The pad can be of any suitable size and shape, preferably being of a width (approximately $\frac{5}{8}$") commensurate with the unperforated area 35, and of a length so as to extend between the flange 24 and the adjacent wall of the rib 26.

It will thus be seen that the present invention provides substantial advantages over prior art constructions of this general type. The central rib 26 of the fill slat provides a rigid, unperforated beam which strengthens the fill slat and permits relatively greater water loading without deformation or resulting stress. The rib is of generally inverted v-shape and open at the bottom, thereby permitting a plurality of fill slats to be superimposed on one another in nested fashion to facilitate shipping and installation, and reduce shipping volume and consequent cost. The side flanges 24 strengthen the fill slat in the side regions thereof and are unperforated except for slots 30, 32 and 34 which effectively receive the supporting wires to maintain the fill slat in position and preclude tilting or rolling or longitudinal movement. Such movement is further precluded by the holding clip 40, which can be positioned over the flange at the location of the central opening 32, or, in addition, over the angular slots or openings 30 and 34. Resilient pads located beneath the body of the fill slat adjacent the slots prevent wear or cutting of the body of the fill slat thereby eliminating a significant problem in prior fill slat mounting arrangements.

It will be understood by those skilled in the art that departures can be made from the foregoing description without, however, departing from the concepts of the present invention. For example, although the inverted v-shape rib provides maximum beam strength, other shapes of ribs could be employed where maximum beam strength is not a critical factor. However, any variation must be able to handle water loading without deformation, while at the same time being open at the bottom so as to permit nesting of the fill slats during shipment.

I claim:

1. A fill slat assembly for use in a water cooling tower of the type having a grid of interconnected vertical and horizontal supporting wires, said fill slat comprising:

(a) a body portion having a plurality of perforations through which water to be cooled can pass or partially pass, (b) a longitudinal rib extending upwardly from said body portion throughout the length of said slat and located generally centrally transversely of the slat, said rib being unperforated and comprising side walls extending convergingly upwardly relative to a longitudinal central vertical plane through said slat, said rib being open between said side walls and forming a rigidifying beam for the fill slat for absorbing water loading on the slat without deformation thereof, (c) a laterally directed flange formed at each side of said body portion, said flanges extending downwardly at an acute angle relative to a plane through the body portion of said slat, (d) each of said flanges being formed with slots open at the outer surfaces of said flanges and closed at the inner ends thereof, said closed ends being spaced from the juncture of said side flanges with said body portion, said slots being of a depth to receive entirely therewithin horizontal and vertical support wires, and (e) means for positively securing the fill slat in place on the supporting wires so as to reduce rolling or longitudinal movement of said slat relative to said support wires, and reduce the effects of vibration within the tower.

2. The fill slat assembly of claim 1, wherein said rib is generally inverted v-shaped in cross section and comprises side walls oriented at an angle of approximately 15° relative to a longitudinal vertical plane through the transverse center of the fill slat, said side walls converging to form an apex which presents a line contact surface to the water descending in the tower.

3. The fill slat assembly of claim 1, wherein said flanges formed at the side of said fill slat extend downwardly and outwardly at an angle of approximately 45° relative to a plane through the body portion of said fill slat.

4. The fill slat assembly of claim 1, wherein said rib is generally inverted v-shape in cross section and said upwardly converging side walls of said rib form an angle of approximately 15° with a longitudinal vertical plane through the transverse center of the fill slat, and wherein each flange formed at the side of the body portion extends outwardly and downwardly at an angle of approximately 45° with a plane through the body portion of the fill slat.

5. The fill slat assembly of claim 1, wherein said fill slat is formed of extrudable, thermoplastic material.

6. The fill slat assembly of claim 1, wherein said means for securing said fill slat to said supporting wires comprises longitudinally spaced slots formed in each side flange of said fill slat, two of said slots in each flange being formed relatively adjacent to the opposed ends of such flange, with a further slot being formed generally intermediate the length of the flange, the slots formed adjacent to the ends of the flanges having axes directed toward the longitudinal center of the fill slat and being of a width and depth to receive therewithin said horizontal and vertical supporting wires, with the direction of the opposed end slots serving to lock the fill slat in position on the supporting wires and prevent longitudinal movement of the fill slat relative to the supporting wires.

7. The fill slat assembly of claim 6, wherein said intermediate slot in each flange has an axis generally perpendicular to the longitudinal axis of said fill slat.

8. The fill slat assembly of claim 1, wherein said body portion is unperforated transversely between pairs of slots in opposed flanges, and further including a resilient pad mounted on the undersurface of said fill slat in said unperforated regions, said pads being located at the juncture of said body portion and said flanges in the vicinity of said slots, said pads preventing wear and cutting of said body portion.

9. The fill slat assembly of claim 1, wherein said means for positively securing the fill slat in place on the supporting wires comprises a holding clip, said holding clip being generally U-shaped in cross section, formed of two legs and a connecting web, the spacing of said legs being greater than the thickness of said flanges, each leg being formed with a slot open at the free end of said leg and terminating adjacent the connecting web, the width of each of said slots being such as to accommodate the total thickness of said vertical and horizontal supporting wires which are positioned in an adjacent slot formed in said flange, whereby said clip can be positioned over said flange, with the slots in the legs of said clip receiving said wires, said clip preventing longitudinal and rolling movements of said fill slat when the latter is in operative position.

10. The fill slat assembly of claim 9, wherein the inner surface of at least one of said legs of said clip is formed with a series of spaced projections extending longitudinal of the clip, and at least the undersurface of at least one of the slots formed in each flange is formed with complimentary recesses, whereby insertion of said clip on said flange as aforesaid results in the engagement of said projections formed on said leg with the recesses formed on the undersurface of said flange around said slot, thereby locking said clip in place.

11. The fill slat assembly of claim 10, wherein the undersurfaces of both legs of said clip are formed with serrations or projections extending longitudinally of said clip, and the associated flange is formed with recesses on both its top and bottom surfaces around and to either side of at least one of the slots formed in the flange, whereby said clip is locked to both the top and bottom surfaces of said flange.

12. The fill slat assembly of claim 11, wherein each of said flanges at the location of each of said slots is formed with recesses on the top and undersurface of said flange around said slot, and wherein a holding clip is mounted at each slot location on each flange.

* * * * *